United States Patent [19]

Schnall et al.

[11] 4,134,667

[45] Jan. 16, 1979

[54] DRUM ASSEMBLY FOR ELECTROSTATIC COPIER

[75] Inventors: Günther Schnall, Eching; Erich Schlick, Riedmoos; Hanns Blöchl, Unterhaching, all of Fed. Rep. of Germany

[73] Assignee: AGFA-Gevaert AG, Leverkusen, Fed. Rep. of Germany

[21] Appl. No.: 781,454

[22] Filed: Mar. 25, 1977

[30] Foreign Application Priority Data

Apr. 9, 1976 [DE] Fed. Rep. of Germany ..... 2615617

[51] Int. Cl.[2] ..... G03G 15/00; B21B 31/08; G03G 21/00

[52] U.S. Cl. ..... 355/3 DR; 29/123

[58] Field of Search ..... 355/3 R, 3 DR, 133; 29/123

[56] References Cited

U.S. PATENT DOCUMENTS

| | | | |
|---|---|---|---|
| 2,165,759 | 7/1939 | Nyborg | 29/123 UX |
| 3,490,841 | 1/1970 | Cely et al. | 355/3 DR |
| 3,518,739 | 7/1970 | Butler | 29/123 |
| 3,804,512 | 4/1974 | Komori et al. | 355/3 DR X |
| 3,994,053 | 11/1976 | Hunt | 29/123 |

FOREIGN PATENT DOCUMENTS

| | | | |
|---|---|---|---|
| 2021409 | 11/1971 | Fed. Rep. of Germany | 355/3 DR |

*Primary Examiner*—Fred L. Braun
*Attorney, Agent, or Firm*—Michael J. Striker

[57] ABSTRACT

A drum assembly for an electrostatic copier having a stationary frame comprises a cylindrically tubular drum whose outer surface carries a light-sensitive coating. A pair of rings are snugly engaged with the outer ends of the drum and are mounted via roller bearings on the frame for rotation about a common ring axis. A support sleeve is non-rotatably fixed to the frame between the rings and within the drum and has an outer surface which normally lies out of contact with the drum and only serves to support the drum as it is being fitted into the machine, so as to protect its delicate light-sensitive coating. One of the rings can be removed from the frame so as to allow axial withdrawal of the drum.

14 Claims, 1 Drawing Figure

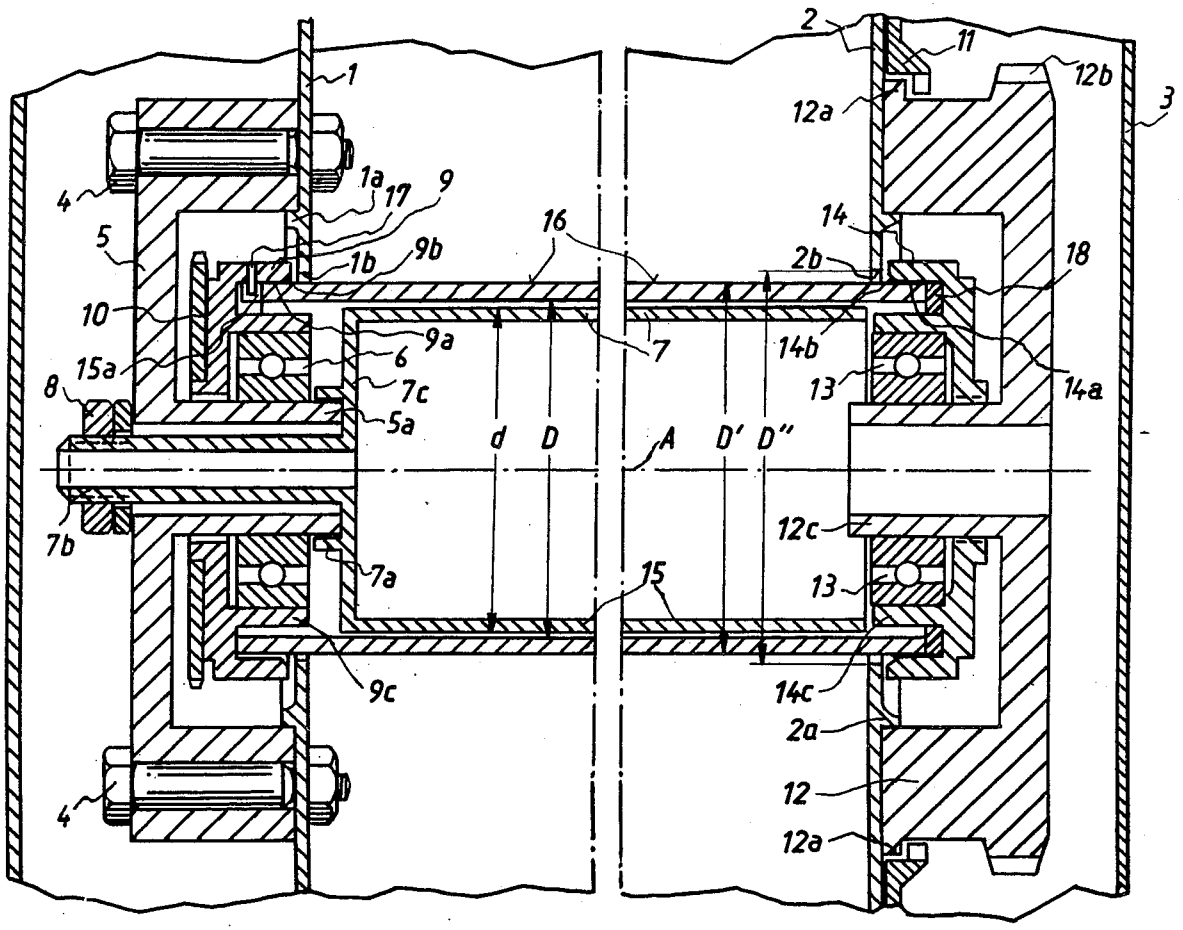
3
12b
18
14a
11
2
12a
14
2b
14b
13
12c
13
14c
2a
12
12a
D''
D'
A
7
15
16
D
d
9
9b
9a
6
7c
5a
7a
9c
1a
17
1b
1
5
10
15a
8
7b
4
4

DRUM ASSEMBLY FOR ELECTROSTATIC COPIER

BACKGROUND OF THE INVENTION

The present invention relates to a drum assembly for an electrostatic copier. More particularly this invention concerns an arrangement for releasably mounting a light-sensitive copy drum in an electrostatic copying apparatus.

An electrostatic or xerographic copier such as described in commonly assigned U.S. Pat. No. 3,734,604 has a cylindrical drum provided on its outer surface with a light-sensitive coating. It is essential that the surface carrying this coating be perfectly cylindrical and rotate about a perfectly stationary axis. Thus recourse has earlier been had to massive drums which are painstakingly machined and supported on heavy-duty bearings.

In recent times in an effort to save costs it has been suggested to provide the light-sensitive coating on a relatively light-duty tubular drum that itself is supported on a support sleeve. Thus if the surface of the drum is damaged it is possible to exchange it with another tubular drum that costs a great deal less than the whole drum assembly. In use of an electrostatic copier an occassional paper jam frequently will damage the thin drum coating and necessitate changing the drum and vacuum-plating a new coating of selenium on the damaged drum.

The problem with these known arrangements is that the drum must be meticulously and painstakingly secured in place on the support sleeve. Furthermore this support sleeve must in turn be adequately supported in the stationary copier frame, so that the complex structure which makes exchanging the drum possible is in itself quite expensive. The sleeve must be very rigid and can only be rotatably supported at one of its ends, as the drum must be able to slip over the other free end.

One solution to this difficulty has been to provide guide rollers which ride on that surface of the drum turned toward the lens system that casts the image to be copied on the drum. These guide rollers insure that the critical portion of the drum is properly positioned. This arrangement has proven itself unsatisfactory in practice and often leads to damaging of the delicate selenium coating on the drum.

SUMMARY OF THE INVENTION

It is therefore an object of the present invention to provide an improved drum assembly for an electrostatic copier.

Another object is to provide such a drum assembly which is relatively inexpensive to manufacture and yet which allows the drum to be exchanged relatively easily.

Yet another object is the provision of such a drum assembly which insures exact centering of the drum and which nonetheless allows a relatively light-duty tubular drum carrying a light-sensitive coating to be employed.

These objects are attained according to the present invention in a drum assembly wherein the tubular outer drum is supported in a pair of rings each engaged in one of the drum ends and supported on the stationary copier frame for rotation about a common ring axis with the drum snugly engaged between the rings. A support sleeve is provided on the machine frame between the rings and on the rotation axis thereof. This sleeve has an outer sleeve diameter which is smaller than the inner drum diameter so that when the drum is snugly engaged between the rotatable mounting rings the sleeve is radially spaced inwardly from it. According to this invention this sleeve is non-rotatably secured to the frame.

Thus with the system according to the present invention the support sleeve serves merely to guide the drum as it is fitted into the machine. Once the drum is in place it is carried only by the mounting rings and is out of engagement with the sleeve. Thus the sleeve need not be perfectly centered or particularly strong, as its sole function is to prevent scratching of the delicate outer surface of the drum as the drum is fitted into the machine. Furthermore the provision of two separate rings rotatable about a common axis on the support frame of the machine makes it a relatively simple matter to define a prefectly stationary rotation axis for the drum, as both ends are supported at the rings on the machine frame.

According to a further feature of this invention each of the rings is formed with a surface tapered away from the other ring and radially engageable with the outer surface of the drum. These surfaces are frustoconical and serve to center the drum perfectly on the axis of rotation therefor.

In accordance with further features of this invention the copier frame comprises a pair of axially spaced parallel plates. One of these plates carries a bearing on which one of the rings is permanently mounted. This one ring is provided with a gear that is connected to the drum drive for the copier. The other ring is removably securable by means of a bayonet connection and a respective roller bearing to the other of the plates. This other plate is formed with an axially throughgoing hole somewhat larger than the outer drum diameter. Thus the other ring can be removed from the machine frame for replacement of the drum.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawing.

BRIEF DESCRIPTION OF THE DRAWING

The sole FIGURE of the drawing is an axial section through the drum assembly according to the present invention.

DESCRIPTION OF A PREFERRED EMBODIMENT:

As shown in the drawing a xerographic or electrostatic copier as described in the above-cited patent has a frame constituted by a pair of parallel and stationary plates 1 and 2 received within a housing 3. Secured to the plate 1 by means of heavy bolts 4 is an annular mounting body 5 formed with a cylindrically tubular extension **5*a* centered on an axis A perpendicular to the plates 1 and 2. A rigid support sleeve 7 of cylindrically tubular shape has an outer diameter d and an end wall 7*c* from which extends an axial and a tubularly hollow shaft 7*b* that passes through the extension 5*a* and that is threaded so that a nut 8 can clamp the sleeve 7 fixedly to the element 5. In addition an annular rim 7*a* surrounds the extension 5*a* so that the sleeve 7** remains centered on but non-movable axially and angularly relative to the axis A.

The fixed extension 5a carries the inner race of a roller bearing 6 whose outer race is carried on an annular extension or rim 9c of a mounting ring 9 that is rotatable by means of the bearing 6 about the axis A and that carries a gear wheel 10 connected to the not-illustrated drive of the copier.

The other plate 2 is provided with a fixed ring 11 that forms with formations 12a a bayonet coupling for a removable mounting ring 12 having an outer edge formed with teeth 12b allowing it to be limitedly rotated about the axis A and physically removed from the plate 2. This ring 12 has a central axial extension 12c centered on the axis A and carrying the inner race of a roller bearing 13 whose outer race is fixed to an annular axial extension 14c of a mounting ring 14.

The plates 1 and 2 are formed with respective centering formations 1a and 2a for the rings 5 and 12 respectively and with axially throughgoing holes 1b and 2b of circular shape and centered on the axis A. A tubularly cylindrical drum 15 having an outer surface provided with a selenium coating 16 extends with spacing through these openings 1b and 2b and has opposite ends engaged by the rings 9 and 14. To this end the rings 9 and 14 have seat formations 9a and 14a of cylindrical shape leading into centering formations 9b and 14b of frustoconical shape so that the ends of the drum 15 is perfectly centered within these rings 9 and 14 relative to the axis A.

The ring 9 is provided with a radially extending pin 17 that engages within an axially open notch or slot 15a formed in one axial end of the drum 15 so as to form a rotation coupling between the drive ring 9 and the drum 15. The other ring 14 has at the base of the axially open annular groove formed between the surface 14a and the rim 14c an elastomeric washer 18 that is compressed when the assembly is together as shown in the drawing and which serves to axially press the drum 15 against the ring 9.

The drum 15 has an inner diameter D which is slightly greater than the outer diameter d of the sleeve 7 i.e. the diameter d is equal to at least nine-tenths of the diameter D. Furthermore this drum has an outer diameter D′ which is smaller than the inner diameter D″ of the holes 1b and 2b by a difference which is greater than the difference between the diameter d and D.

Thus in use the drum 15 is rotated about the axis A and remains completely out of contact with the sleeve 7. Each of the mounting rings 9 and 14 is rigidly fixed on the axis A so that any deviation of the drum from the axis A is impossible. Of course, the rings 9, 14 are also rotatable about the axis A by virtue of being supported by the bearing 6, 13.

When, however, it is necessary to remove the drum 15 one need merely rotate the ring 12 slightly so as to disconnect the bayonet coupling formations 11 and 12a. The ring 12 is then pulled axially away from the wall 2 so that all of the structure, including the ring 14, in engagement with the right-hand end of the drum 15 is moved out of the way. Thereafter the drum 15 can be slid out of the ring 9 and along the sleeve 7 for removal. Since the spacing between the outer surface of the drum 15 and the inner edges of the holes 1b and 2b is greater than the spacing between the inner surface of the drum 15 and the outer surface of the sleeve 7 contact between the plates 1 and 2 and the coating 16 is impossible.

After the drum has been removed it is possible very quickly to slide a new drum in place. The centering formations 9b and 14b will insure that, when the ring 14 is again secured in place, the new drum 15 will be perfectly centered on the axis A.

It will be understood that each of the elements described above, or two or more together, may also find a useful application in other types of machines differing from the types described above.

While the invention has been illustrated and described as embodied in a electrostatic copier, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A drum assembly for an electrostatic copier having a stationary frame, said assembly comprising a cylindrically tubular drum having an outer drum surface, an inner drum diameter, and a pair of drum ends; a light-sensitive coating on said outer surface; a pair of rings respectively snugly engageable with said drum ends, each of said rings having an inner engaging surface which tapers axially in a direction away from the respective other ring and engages around the respective drum end in contact with said outer drum surface; means supporting said rings on said frame for rotation about a common axis with said drum snugly engaged between said rings; and a support sleeve secured to said frame generally between said rings and on said axis and having an outer sleeve diameter smaller than said inner drum diameter, said sleeve being out of contact and radially spaced from said drum when the same is snugly engaged between said rings.

2. The assembly defined in claim 1; further comprising means non-rotatably securing said sleeve to said frame.

3. The assembly defined in claim 1, wherein said engaging surfaces are frustoconical.

4. The assembly defined in claim 1, wherein said means supporting said rings includes a pair of roller bearings respectively supporting said rings on said frame.

5. The assembly defined in claim 1; further comprising means releasably securing one of said rings to said frame and means fixing the other of said rings to said frame.

6. The assembly defined in claim 1; further comprising means connected to one of said rings for rotating the same about said axis, and interengaging formations on said one ring and the respective end of said drum for transmitting rotation between said one ring and said drum.

7. The assembly defined in claim 6, wherein said formation on said drum is an axially open slot.

8. The assembly defined in claim 6, wherein said means connected to said one ring is a gear wheel fixed thereto.

9. The assembly defined in claim 1, wherein one of said rings has an elastomeric body and axially bears via the same on the respective drum end.

10. The assembly defined in claim 9, wherein said one ring has an axially open annular groove centered on said axis and containing said elastomeric body.

11. The assembly defined in claim 1, wherein said outer sleeve diameter is equal to at least nine-tenths of said inner drum diameter.

12. A drum assembly for an electrostatic copier having a stationary frame, said assembly comprising a cylindrically tubular drum having an outer drum surface, an inner drum diameter, and a pair of drum ends; a light-sensitive coating on said outer surface; a pair of rings respectively snugly engageable with said drum ends; means supporting said rings on said frame for rotation about a common axis with said drum snugly engaged between said rings; a support sleeve secured to said frame generally between said rings and on said axis and having an outer sleeve diameter smaller than said inner drum diameter, said sleeve being out of contact and radially spaced from said drum when same is snugly engaged between said rings; and means releasably securing one of said rings to said frame including a bayonet coupling between said one ring and said frame and means fixing the other of said rings to said frame.

13. A drum assembly for an electrostatic copier having a stationary frame, said assembly comprising a cylindrically tubular drum having an outer drum surface, an inner drum diameter, and a pair of drum ends; a light-sensitive coating on said outer surface; a pair of rings respectively snugly engageable with said drum ends; means supporting said rings on said frame for rotation about a common axis with said drum snugly engaged between said rings; a support sleeve secured to said frame generally between said rings and on said axis and having an outer sleeve diameter smaller than said inner drum diameter, said sleeve being out of contact and radially spaced from said drum when same is snugly engaged between said rings; and means releasably securing one of said rings to said frame and means fixing the other of said rings to said frame, said frame and said one ring being provided with interengaging centering formations centered on said axis.

14. A drum assembly for an electrostatic copier having a stationary frame, said assembly comprising a cylindrically tubular drum having an outer drum surface, an inner drum diameter, and a pair of drum ends; a light-sensitive coating on said outer surface; a pair of rings respectively snugly engageable with said drum ends; means supporting said rings on said frame for rotation about a common axis with said drum snugly engaged between said rings; and a support sleeve secured to said frame generally between said rings and on said axis and having an outer sleeve diameter smaller than said inner drum diameter, said sleeve being out of contact and radially spaced from said drum when same is snugly engaged between said rings, said frame being formed with a throughgoing hole centered on said axis, said hole having an inner hole diameter exceeding the outer diameter of said drum by a difference greater than the difference between said inner drum diameter and said outer sleeve diameter, whereby said drum can pass through said hole in contact with said sleeve without touching said frame.

* * * * *